US006459867B2

(12) United States Patent
Ohgoshi et al.

(10) Patent No.: US 6,459,867 B2
(45) Date of Patent: Oct. 1, 2002

(54) DEVELOPING APPARATUS

(75) Inventors: Toshihide Ohgoshi; Shigeyuki Wakada, both of Nara; Eiichi Kido, Yamatokoriyama; Atsushi Inoue, Ikoma-gun; Takayuki Yamanaka, Tenri; Masahiro Sakai; Hiroshi Ishii, both of Osaka; Jitsuo Masuda, Yamatotakada, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/769,384

(22) Filed: Jan. 26, 2001

(30) Foreign Application Priority Data

Jan. 26, 2000 (JP) ..... 2000-017304

(51) Int. Cl.[7] ..... G03G 15/08
(52) U.S. Cl. ..... 399/103; 399/284
(58) Field of Search ..... 399/103, 105, 399/102, 284; 118/261

(56) References Cited

U.S. PATENT DOCUMENTS 4,412,733 A * 11/1983 Doutney ..... 399/269
5,587,551 A * 12/1996 Ikegawa et al. ..... 399/284
5,655,178 A * 8/1997 Ishikawa et al. ..... 399/102
6,049,689 A 4/2000 Ishii et al. ..... 399/284
6,094,550 A * 7/2000 Kido et al. ..... 399/103
6,356,723 B1 * 3/2002 Sato et al. ..... 399/103

FOREIGN PATENT DOCUMENTS

| | | | |
|---|---|---|---|
| JP | 59219764 | | 12/1984 |
| JP | 09-043981 | * | 2/1997 |
| JP | 09-281799 | * | 10/1997 |
| JP | 11-327294 | * | 11/1999 |

* cited by examiner

*Primary Examiner*—Sophia S. Chen

(57) ABSTRACT

A developing apparatus capable of supplying a uniform thin layer of toner and of preventing toner scattering and leakage is provided, where the developing apparatus includes a supply roller for supplying toner to an outer peripheral surface of a toner carrier, the toner carrier for transferring the supplied toner by rotation and a layer thickness controlling member for controlling a thickness of the layer of the supplied toner at a predetermined value while making slide contact with the outer peripheral surface of the toner carrier via the toner, wherein the thin toner layer is supplied to an electrostatic latent image on an image carrier. The layer thickness controlling member is formed of an elastic plate to have a bent portion convex toward the toner carrier. The layer thickness controlling member is held by sealing members so that the bent portion makes elastic contact with the toner carrier outer peripheral surface over a nearly entire length of the toner carrier.

16 Claims, 8 Drawing Sheets

DEVELOPING APPARATUS

BACKGROUND OF THE INVENTION

1. Field of the Invention

The present invention relates to a developing apparatus that uses one-component toner, and more particularly to a developing apparatus for an image forming device, such as an electrophotographic copier.

2. Description of the Related Art

Numerous developing apparatuses that use one-component toner, such as an electrophotographic copier, perform development by forming toner used as a developing material into a uniform thin layer, by electrically charging the toner as necessary, and by attaching the charged toner to an electrostatic latent image on an image carrier.

The development method specifically described below is well known. In this method, toner is first supplied to a rotating cylindrical toner carrier, and a layer thickness controlling member extending in parallel with the toner carrier is made contact with the outer peripheral surface of the toner carrier to which the toner has been supplied, whereby the toner on the toner carrier is formed into a uniform thin layer. At the same time, the toner is electrically charged as necessary for development by friction charging, charge implantation or the like. After this, the charged toner layer is transferred to the contact portion wherein the image carrier makes contact with the toner carrier as the toner carrier rotates. The toner on the toner carrier is attached to an electrostatic latent image on an image carrier.

In the case of the above-mentioned development method, a method of controlling the thickness of the toner layer is carried out frequently in order to obtain excellent image quality. In this method, the surface or the edges of the layer thickness controlling member having the shape of a thin plate formed of a metal member, a high molecular resin member or a lamination of a metal member and a high molecular resin member are made contact with the toner carrier in order to control the thickness of the toner layer.

In this case, toner is not consumed in the vicinity of both end portions of the toner carrier corresponding to the non-image area of the electrostatic latent image. Furthermore, toner is moved to both end portions of the toner carrier by the dispersion action as the toner carrier rotates. Toner is thus oversupplied, resulting in toner scattering and leakage. This causes problems of contaminating the inside of the device, increasing the consumption of toner and the like.

The related art in accordance with Japanese Examined Patent Publication JP-B2 4-62391 (1992) discloses a method of preventing toner from moving to both end portions of the toner carrier, thereby preventing toner from scattering. The developing apparatus in accordance with this method is provided with elastic sealing members for covering both side portions of the end portion of the layer thickness controlling member formed of an elastic material in its longitudinal direction from the back side of its contact surface making contact with the toner carrier. Alternatively, the developing apparatus is provided with elastic sealing members for pressurizing both side portions in the longitudinal direction of the layer thickness controlling member from the back side of its contact surface making contact with the toner carrier inward in the radial direction of the toner carrier.

In the developing apparatus in accordance with the related art disclosed in JP-B2 4-62391 or the like, sealing member are provided on the surface of the layer thickness controlling member making contact with the toner carrier, on the rear surface or on both end side surfaces of the layer thickness controlling member in order to prevent toner leakage. However, slight gaps are apt to occur at both side end portions of the layer thickness controlling member and at the contact portion wherein the layer thickness controlling member makes contact with the toner carrier because of steps caused by the thickness of the layer thickness controlling member. This results in toner scattering and leakage, and causes problems of staining images, contaminating the inside of the device, increasing toner consumption and the like.

If the sealing pressure of the sealing members is raised in order to prevent improper sealing due to the gap at the contact portion wherein the toner carrier makes contact with the layer thickness controlling member, the contact pressure force exerted from the layer thickness controlling member to the toner carrier in the radial direction of the toner carrier increases. This increase of the contact pressure force prevents normal operation of the layer thickness controlling member, and disturbs the formation of the toner layer near both end portions of the layer thickness controlling member, wherein the sealing members are disposed. As a result, image quality may apt to lower at both end portions of an image region, and improper sealing may be apt to occur because of sliding abrasion between the toner carrier and the sealing members or between the toner carrier and the layer thickness controlling member. It is thus very difficult for the above-mentioned developing apparatus to prevent toner scattering and leakage.

SUMMARY OF THE INVENTION

An object of the invention is to provide a developing apparatus capable of supplying a uniform thin layer of toner and capable of preventing toner scattering and leakage.

The invention provides a developing apparatus which performs development by supplying a thin toner layer to an electrostatic latent image on an image carrier, comprising a cylindrical toner carrier for transferring supplied toner to a development position by rotation of the toner carrier, supply means for supplying toner to an outer peripheral surface of the toner carrier, a layer thickness controlling member for controlling thickness of the supplied toner to within a predetermined value while making slide contact with the outer peripheral surface of the toner carrier, and sealing means for holding the layer thickness controlling member and preventing toner leakage, wherein the layer thickness controlling member is formed of an elastic plate extending in parallel with the toner carrier, and has a bent portion which is convex toward the toner carrier and makes elastic contact with the outer peripheral surface of the toner carrier over a nearly entire length thereof, one end of the layer thickness controlling member in a width direction thereof with respect to the bent portion outwardly extending in a radial direction of the toner carrier, a portion on the other side of the layer thickness controlling member in the width direction thereof extending in a peripheral direction of the toner carrier toward a downstream side of the rotation direction of the toner carrier, and the sealing means consisting of an upstream side sealing member which makes contact with the one end of the layer thickness controlling member from an upstream side of the rotation direction of the toner carrier and a downstream side sealing member which makes contact with the one end of the layer thickness controlling member from a downstream side of the rotation direction of the toner carrier, the one end of the layer thickness controlling member being caught between the upstream side sealing member and the downstream side sealing member so that the layer thickness controlling member is held to be elastically displaceable in the radial direction of the toner carrier.

In accordance with the invention, since the convex bent portion of the layer thickness controlling member makes elastic contact with the outer surface of the toner carrier, no step is formed by the thickness of the layer thickness controlling member unlike the related art. As a result, toner leakage can be prevented, and the thickness of the toner layer formed on the toner carrier can be made uniform.

In addition, since the one end of the layer thickness controlling member extending outward in the radial direction of the toner carrier is caught between the upstream side and downstream side sealing members, it is possible to reduce the contact pressure force exerted by the sealing members from the layer thickness controlling member to the toner carrier in the radial direction of the toner carrier. As a result, the sealing members can securely perform sealing without deterioration with a lapse of time without interfering with the movement of the layer thickness controlling member.

In accordance with the invention, between the upstream side sealing member and the downstream side sealing member is caught the one end of the layer thickness controlling member extending in the radial direction of the toner carrier thereby to hold the layer thickness controlling member so that the layer thickness controlling member can be elastically displaced elastically in the radial direction of the toner carrier as described above. The layer thickness controlling member can thus make elastic contact with the toner carrier, whereby it is possible to prevent any adverse effects on the layer thickness controlling member due to the pressure contact forces of the sealing members. The developing apparatus in accordance with the invention can therefore perform uniform toner layer formation, and can securely prevent toner leakage. As a result, in the developing apparatus, it is possible to prevent deterioration in image quality due to a nonuniform toner concentration, a change in concentration, fogging and stains, and it is also possible to prevent contamination inside the device due to toner scattering. Excellent images can thus be formed stably.

Furthermore, in the invention it is preferable that a main component of a pressure contact force exerted from the upstream side sealing member to the layer thickness controlling member is in parallel with the peripheral direction of the toner carrier.

In accordance with the invention, since the main component of the pressure contact force exerted from the upstream side sealing member to the layer thickness controlling member is in parallel with the peripheral direction of the toner carrier, it is possible to prevent the pressure contact force of the sealing members from increasing the pressure contact force of the layer thickness controlling member to the toner carrier. As a result, the developing apparatus in accordance with the invention can attain stable layer thickness control operation and can securely prevent toner leakage simultaneously.

Furthermore, in accordance with the invention, since the main component of the pressure contact force exerted from the upstream side sealing member to the layer thickness controlling member is in parallel with the peripheral direction of the toner carrier, the component of the pressure contact force in the radial direction of the toner carrier is almost negligible. It is thus possible to prevent the toner layer formation by the sealing members from being adversely affected.

Furthermore, in the invention it is preferable that the sealing means is disposed at both ends of the layer thickness controlling member in a longitudinal direction thereof and the upstream side sealing member has a side sealing member which makes contact with the toner carrier.

In accordance with the invention, the side sealing member which makes contact with the toner carrier is provided. It is thus possible to securely prevent toner leakage from the upstream side to the downstream side of the rotation direction of the toner carrier and toner leakage at both ends in the longitudinal direction of the layer thickness controlling member.

Furthermore, in accordance with the invention, since the side sealing member is provided at both ends of the layer thickness controlling member in the longitudinal direction thereof and makes contact with the toner carrier, the layer thickness controlling member can be held by the side sealing member, and toner leakage can be prevented from both ends of the layer thickness controlling member.

Furthermore, in the invention it is preferable that the side sealing member has a fur-planted cloth at a contact portion thereof which makes contact with the toner carrier.

In accordance with the invention, since the side sealing member has the fur-planted cloth at its contact portion which makes contact with the toner carrier, the side sealing member can prevent any sliding friction load between the side sealing member and the toner carrier.

Furthermore, in accordance with the invention, since the side sealing member has the fur-planted cloth at the contact portion making contact with the toner carrier, the side sealing member can prevent any sliding friction load between the side sealing member and the toner carrier. In addition, the side sealing member can securely prevent toner leakage at the contact portion wherein the layer thickness controlling member makes contact with the toner carrier without causing sliding abrasion and breakage. As a result, the side sealing member can securely perform stable sealing for a long time.

Furthermore, in the invention it is preferable that a fur-planting direction of the fur-planted cloth is a forward direction wherein an end of the fur tilts to the downstream side of the rotation direction of the toner carrier.

In accordance with the invention, since the fur-planting direction of the fur-planted cloth is the forward direction not opposite to the rotation direction of the toner carrier, it is possible to reduce the sliding friction resistance between the planted fur and the toner carrier.

Furthermore, in accordance with the invention, since the fur-planting direction of the fur-planted cloth is the forward direction wherein the end of the fur tilts to the downstream side of the rotation direction of the toner carrier, it is possible to reduce the friction resistance between the planted fur and the toner carrier.

Furthermore, in the invention it is preferable that the fur of the fur-planted cloth has such a length that the end of the fur reaches the contact portion wherein a toner carrier side surface of the convex bent portion of the layer thickness controlling member which is bent at a predetermined radius of curvature, makes contact with the outer peripheral surface of the toner carrier.

In accordance with the invention, the end of the fur of the side sealing member can be inserted securely into the contact portion wherein the layer thickness controlling member makes contact with the toner carrier. It is therefore possible to securely prevent toner leakage at the contact portion wherein the layer thickness controlling member makes contact with the toner carrier.

Furthermore, in accordance with the invention, since the fur of the fur-planted cloth has such a length that the end of the fur reaches the contact portion wherein the layer thickness controlling member makes contact with the toner carrier, the end of the planted fur can be securely inserted into the contact portion, and the reliability of the sealing can be improved.

Furthermore, in the invention it is preferable that the upstream side sealing member has a central sealing member for holding the layer thickness controlling member over a nearly entire length of the layer thickness controlling member in a longitudinal direction thereof.

In accordance with the invention, since the central sealing member is provided, it is possible to securely prevent toner leakage from the upstream side to the downstream side of the rotation direction of the toner carrier over the entire length of the layer thickness controlling member in the longitudinal direction without interfering with the movement of the layer thickness controlling member.

Furthermore, in accordance with the invention, the central sealing member for holding the layer thickness controlling member over the nearly entire length in the longitudinal direction can prevent toner leakage from the upstream side to the downstream side of the rotation direction of the toner carrier, and can securely seal toner over the entire length in the longitudinal direction.

Furthermore, in the invention it is preferable that the central sealing member does not make contact with the toner carrier.

In accordance with the invention, since the central sealing member does not make contact with the toner carrier, the central sealing member does not cause any adverse effects on the rotation of the toner carrier, and can securely prevent toner leakage from the upstream side to the downstream side of the rotation direction of the toner carrier.

Furthermore, in accordance with the invention, since the central sealing member does not make contact with the toner carrier, it is possible to prevent any sliding load to the toner carrier from increasing.

Furthermore, in the invention it is preferable that the central sealing member makes contact with the toner carrier at least in an effective region of an image.

In accordance with the invention, since the central sealing member makes pressure contact with the toner carrier in the image region, the toner supplied to the contact portion wherein the layer thickness controlling member makes contact with the toner carrier can be pre-charged with the result of enhancing uniformity of charging of a toner layer.

Furthermore, in accordance with the invention, since the central sealing member makes contact with the toner carrier via the toner layer in the image region, coagulated toner lumps are loosened. In addition, the toner is pre-charged and subjected to other processing. As a result, the toner layer can have higher uniformity, stability and reliability.

Furthermore, in the invention it is preferable that the upstream side sealing member is formed of a soft foam material having independent bubbles.

In accordance with the invention, since the upstream side sealing member is formed of a soft foam material, the upstream side sealing member can securely prevent toner leakage at a low sealing pressure contact force, and can prevent interference with the movement of the layer thickness controlling member.

Furthermore, in accordance with the invention, since the upstream side sealing member is formed of a soft foam material, it is possible to reduce the pressure contact force to the layer thickness controlling member or the toner carrier. In addition, since the soft foam material for the upstream side sealing member is a foam material having independent bubbles, it is possible to prevent toner from leaking through pores in the foam material.

Furthermore, in the invention it is preferable that the downstream side sealing member is bonded to a wall surface of a frame of a developing bath for accommodating toner.

In accordance with the invention, since the downstream side sealing member is bonded to the developing bath frame, it is possible to reduce the pressure contact force of the downstream side sealing member.

Furthermore, in accordance with the invention, since the downstream side sealing member is bonded to the wall surface of the developing bath frame, the assembly of the developing bath can be made more easily, and the sealing can have higher reliability.

Furthermore, in the invention it is preferable that the downstream side sealing member is bonded to the layer thickness controlling member.

In accordance with the invention, since the downstream side sealing member is bonded to the layer thickness controlling member, it is possible to reduce the pressure contact force of the downstream side sealing member.

Furthermore, in accordance with the invention, since the downstream side sealing member is bonded to the layer thickness controlling member, the sealing can have higher reliability. In addition, it is possible to use a sealing member having the same shape as that of the space defined by the developing bath frame and the layer thickness controlling member. The downstream side sealing member can therefore prevent toner leakage without affecting the pressure contact force exerted from the layer thickness controlling member to the toner carrier.

Furthermore, in the invention it is preferable that the downstream side sealing member is positioned inside both ends in a longitudinal direction of the layer thickness controlling member and do not make contact with the toner carrier.

In accordance with the invention, since the downstream sealing member does not make contact with the toner carrier, it is possible to prevent any sliding load from being applied to the toner carrier. As a result, it is possible to prevent the downstream side sealing member and the toner carrier from undergoing sliding abrasion.

Furthermore, in accordance with the invention, the downstream side sealing member can perform sealing without making contact with the toner carrier. As a result, it is possible to prevent any sliding load occurring between the downstream side sealing member and the toner carrier. It is thus possible to prevent deterioration due to abrasion and change with time associated with sliding.

Furthermore, in the invention it is preferable that a main component of a pressure contact force exerted from the downstream side sealing member to the layer thickness controlling member is in parallel with the peripheral direction of the toner carrier.

In accordance with the invention, since the main component of the pressure contact force exerted from the downstream side sealing member to the layer thickness controlling member is in parallel with the peripheral direction of the toner carrier, it is possible to prevent the pressure contact force generated by the elasticity of the downstream side sealing member from increasing the pressure contact force of the layer thickness controlling member to the toner carrier. As a result, the developing apparatus in accordance with the invention can attain stable layer thickness control operation and can securely prevent toner leakage simultaneously.

Furthermore, in accordance with the invention, since the direction of the pressure contact force exerted from the downstream side sealing member is in parallel with the peripheral direction of the toner carrier, the component of the pressure contact force exerted from the downstream side sealing member in the layer thickness control direction can be eliminated. It is thus possible to prevent the toner layer formation by the downstream side sealing member from being adversely affected.

Furthermore, in the invention it is preferable that the downstream side sealing member is formed of a soft foam material having independent bubbles.

In accordance with the invention, since the downstream side sealing member is formed of a soft foam material, the downstream side sealing member can securely prevent toner leakage at a low sealing pressure contact force, and can prevent interference with the movement of the layer thickness controlling member.

Furthermore, in accordance with the invention, since the downstream side sealing member is formed of a soft foam material, it is possible to reduce the pressure contact force of the downstream side sealing member. In addition, since the soft foam material for the downstream side sealing member is a foam material having independent bubbles, it is possible to prevent toner from leaking through the pores in the foam material.

Furthermore, in the invention it is preferable that the downstream side sealing member is formed of a soft foam material having a hardness of 250N or less in accordance with JIS K6401.

In accordance with the invention, the downstream side sealing member can securely prevent toner leakage at a low sealing pressure contact force, and can prevent interference with the movement of the layer thickness controlling member.

Furthermore, in accordance with the invention, since the downstream side sealing member is formed of a foam material having a hardness of 250N or less in accordance with JIS K6401, the downstream side sealing member can securely prevent toner leakage without interfering with the movement of the layer thickness controlling member, and can form a uniform toner layer stably.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
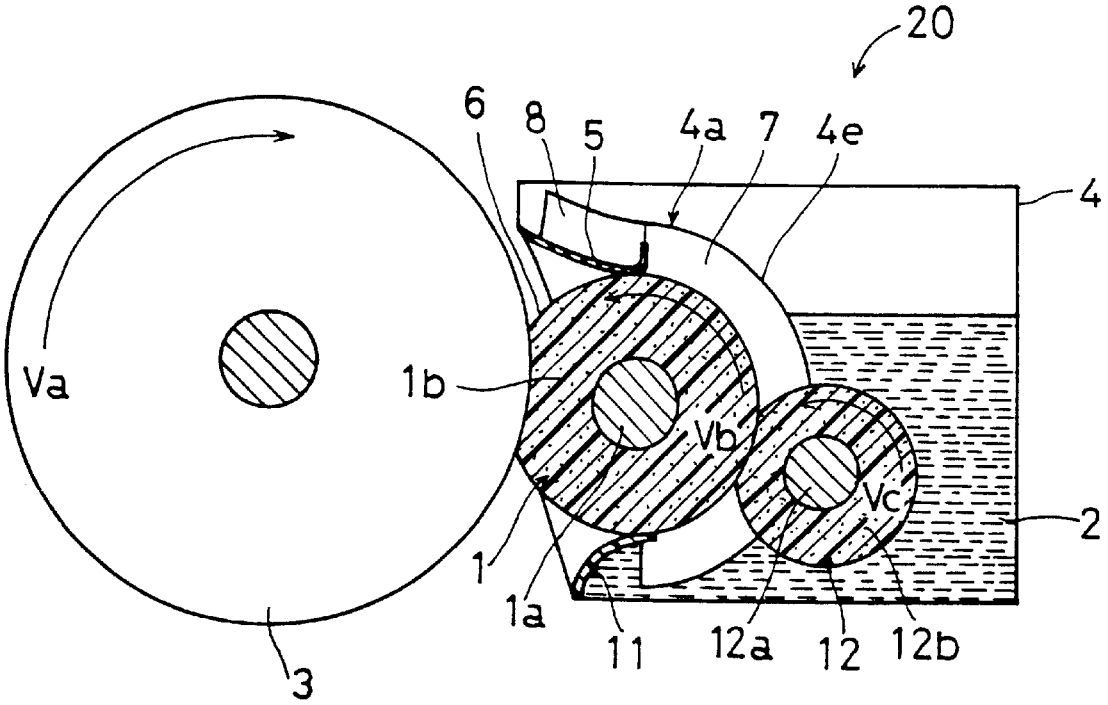
FIG. 1 is a side sectional view showing a developing apparatus 20 in accordance with an embodiment of the invention.

Now referring to the drawings, preferred embodiments of the invention are described below.

Figure 2:
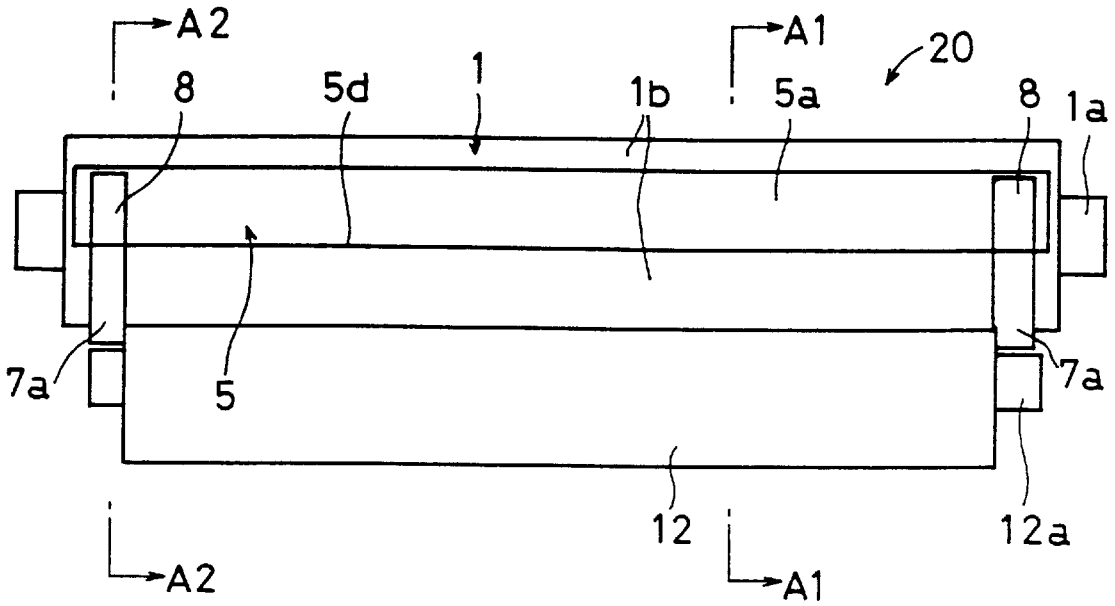
FIG. 2 is a top plan view showing a part of the developing apparatus 20.
Figure 3:
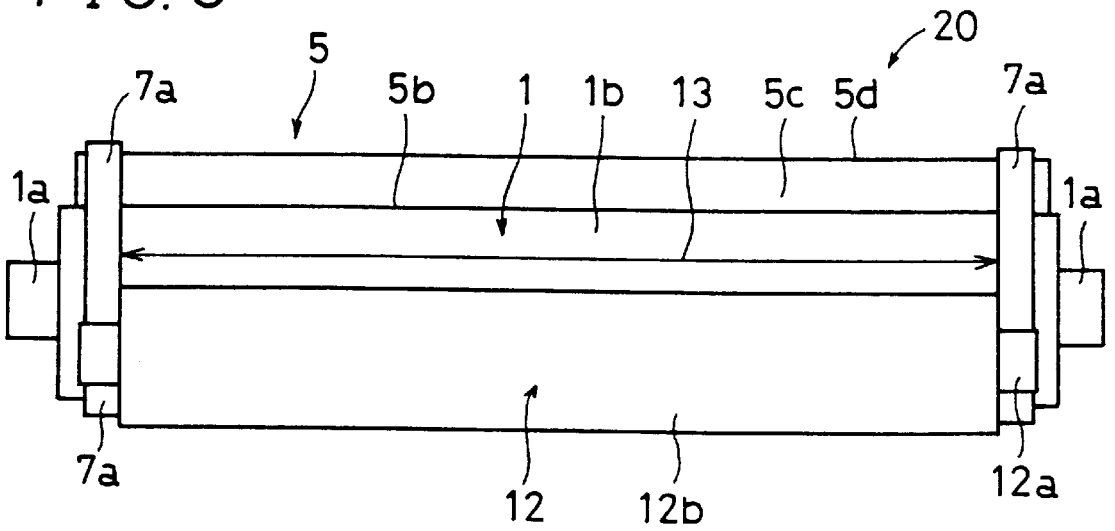
FIG. 3 is a rear view showing a part of the developing apparatus 20.

FIG. 1 is a side sectional view showing a developing apparatus 20 in accordance with an embodiment of the invention. FIG. 2 is a top plan view showing a part of the developing apparatus 20. FIG. 3 is a rear view taken from the right of FIG. 1 and showing a part of the developing apparatus 20. FIG. 1 is a sectional view taken on the section line A1—A1 of FIG. 2. The developing apparatus 20 comprises a developing bath frame 4 accommodating toner 2, a cylindrical supply roller 12 for supplying the toner 2 to the outer peripheral surface of a toner carrier 1 by rotation, the cylindrical toner carrier 1 for transferring the supplied toner to a development position by rotation, a layer thickness controlling member 5 for controlling the layer thickness of the supplied toner at a predetermined value by making slide contact with the outer peripheral surface of the toner carrier 1 via the toner, upstream side sealing members 7 disposed on the upstream side of the rotation direction of the toner carrier 1 to hold the layer thickness controlling member 5, sealing members 8 disposed on the downstream side of the rotation direction of the toner carrier 1 to hold the layer thickness controlling member 5, and a lower seal 11 for making slide contact with the nearly entire length of the outer peripheral surface of the toner carrier 1.

The developing apparatus 20 is applied to an electrophotographic laser printer and the like. It carries out development by supplying a toner layer 6 thinned on the outer peripheral surface of the toner carrier 1 to an electrostatic latent image on the outer peripheral surface of a cylindrical image carrier 3 for example. The toner carrier 1, the toner 2, the layer thickness controlling member 5, the upstream side and downstream side sealing members 7 and 8, the lower seal 11 and the supply roller 12 are accommodated in the developing bath frame 4. Furthermore, the cylindrical supply roller 12, the toner carrier 1 and the image carrier 3 are disposed in this order so that their center axes are parallel with one another.

The toner carrier 1 is formed by providing a carbon-dispersed conductive urethane rubber 1*b* having an electrical resistance of $10^6$ Ωcm and having a JIS A hardness of about 60 degrees in accordance with the JIS K6253 on the outer periphery of a 10 mm diameter stainless steel core 1*a* to which a developing bias of −300 V is applied. The toner carrier 1 is a cylinder having an outside diameter of 27 mm, and rotates at a peripheral speed of 228 mm/sec in a counterclockwise direction Vb shown in FIG. 1 from the supply roller 12 to the image carrier 3. The toner carrier 1 makes pressure contact with the cylindrical image carrier 3 rotating at a peripheral speed of 175 mm/sec in a direction Va opposite to the rotation direction of the toner carrier 1 thereby to transfer the toner supplied to the outer peripheral surface to its contact portion making contact with the image carrier 3.

The supply roller 12 is formed by providing a carbon-dispersed conductive urethane foam 12*b* on the outer periphery of an 8 mm diameter stainless steel core 12*a* to which a supplying bias of −350 V is applied. The supply roller 12 is a cylinder having an outside diameter of 20 mm. The supply roller 12 makes contact with the toner carrier 1 at a contact depth of 0.5 mm and at a supply nip width of about 6 mm, and rotates at a peripheral speed of 205 mm/sec in the same direction Vc as the rotation direction of the toner carrier 1. The carbon-dispersed conductive urethane foam 12*b* of the supply roller 12 has an electrical resistance of $10^5$ Ωcm, a cell density of 80 pieces/25 mm and a hardness of about 235N in accordance with JIS K6401.

By rotating in the same direction as that of the toner carrier 1, the supply roller 12 supplies an appropriate amount of the non-magnetic 1-component toner 2 accommodated in the developing bath frame 4 to the outer peripheral surface of the toner carrier 1 while the toner 2 is preliminarily charged. Furthermore, the supply roller 12 removes extra toner remaining on the toner carrier 1 after development. The toner 2 has a high electrical resistance, is negatively charged, and has an average particle diameter of about 7.5 μm. The toner 2 is supplied from the supply roller 12 to the outer peripheral surface of the toner carrier 1. Part of the toner 2 supplied to the outer peripheral surface of the toner carrier 1 is transferred to the image carrier 3 thereby to form a toner image.

Figure 4:
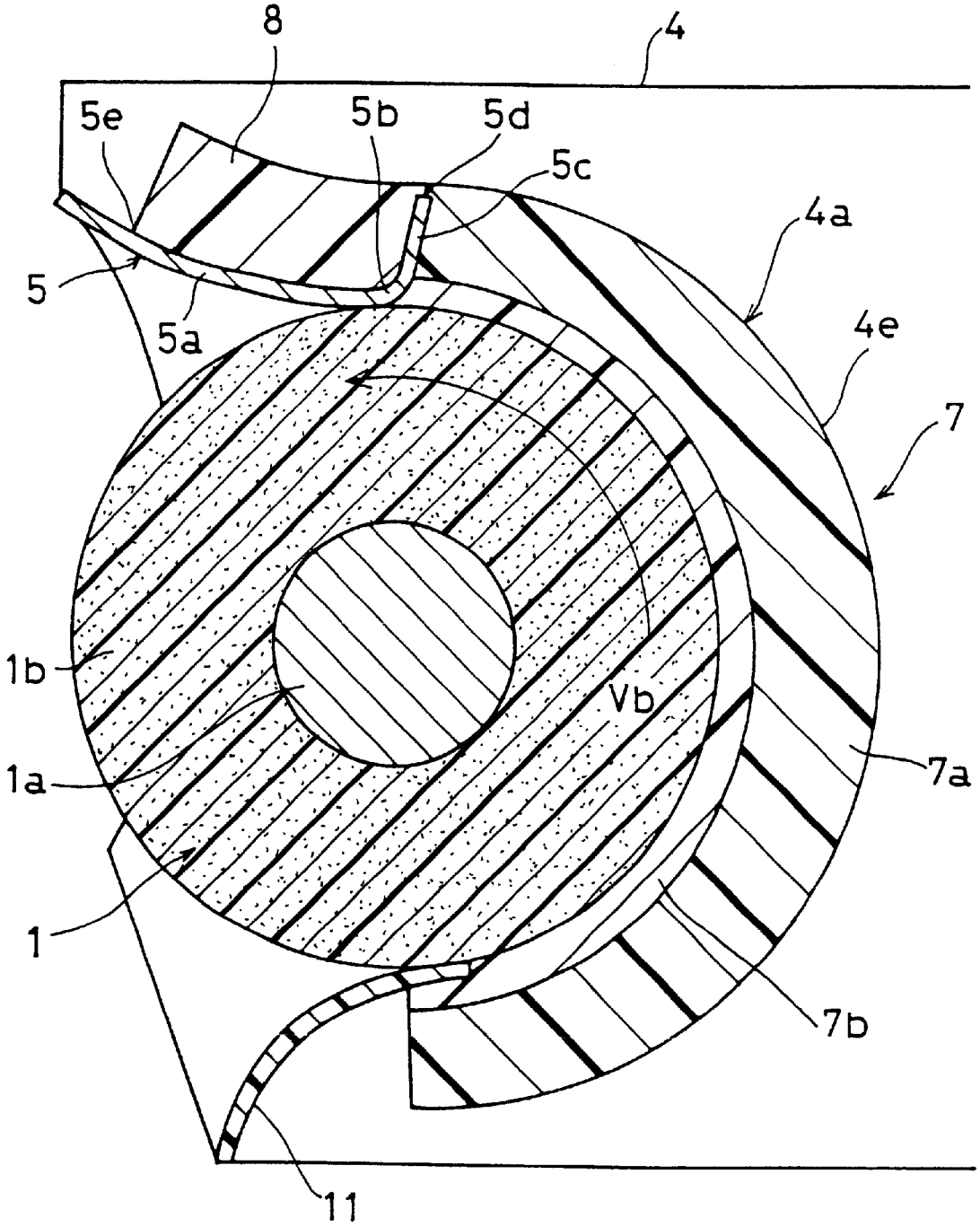
FIG. 4 is a magnified view showing the vicinity of the toner carrier 1 of the developing apparatus 20.
Figure 5:
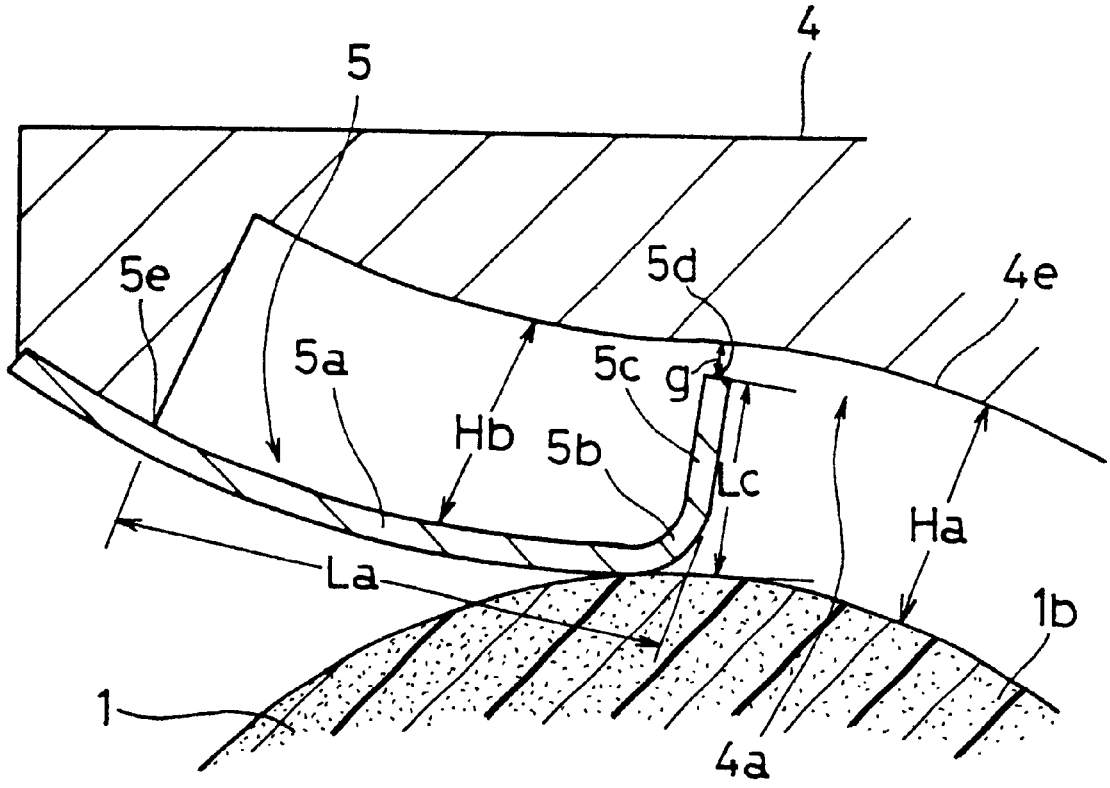
FIG. 5 is a magnified view showing the vicinity of the layer thickness controlling member 5 of the developing apparatus 20.

FIG. 4 is a magnified view showing the vicinity of the toner carrier 1. FIG. 5 is a magnified view showing the vicinity of the layer thickness controlling member 5. FIGS. 4 and 5 are sectional views taken on the section line A2—A2 of FIG. 2. In FIG. 5, the upstream side and downstream side sealing members 7 and 8 are omitted. The layer thickness controlling member 5 to which a supply bias of −350 V is applied is formed of a 0.1 mm thick stainless steel plate spring extending along the outer peripheral surface of the toner carrier 1. The layer thickness controlling member 5 is bent so as to become convex toward the toner carrier 1. Both ends in the longitudinal direction of the layer thickness controlling member 5 are held by the upstream side and downstream side sealing members 7 and 8 so that its bent portion 5*b* makes contact with the outer peripheral surface of the toner carrier 1 along its nearly entire length.

The bent portion 5*b* of the layer thickness controlling member 5 is bent at about 90 degrees. The flat portion 5*a* of the layer thickness controlling member 5 on one side in its width direction extends from the bent portion 5*b* in the peripheral direction of the toner carrier 1. The fixed end 5*e* of the flat portion 5*a* is installed in the developing bath frame 4. Furthermore, the one end 5*c* of the layer thickness controlling member 5 on the other side in its width direction extends outward in the radial direction of the toner carrier 1 from the bent portion 5*b*. The length La of the flat portion 5*a* is 15 mm, the radius of curvature of the bent portion 5*b* is 1 mm, and the length Lc of the one end 5*c* is 5 mm.

Inside the developing bath frame 4 are provided concave portions 4*a* for holding the upstream side and downstream side sealing members 7 and 8 in regions adjacent to an image region 13, that is, regions at both ends in the longitudinal direction of the layer thickness controlling member 5. The concave portion 4*a* is provided from the one end 5*c* of the layer thickness controlling member 5 along the outer peripheral surface of the toner carrier 1 on the upstream side of the rotation direction of the toner carrier 1. Furthermore, on the downstream side, the concave portion 4*a* is provided along the flat portion 5*a* of the layer thickness controlling member 5. The distance Ha between the inner peripheral surface 4*e* of the concave portion 4*a* on the upstream side of the rotation direction of the toner carrier 1 and the outer peripheral surface of the toner carrier 1 is 6 mm. In addition, the distance Hb between the inner peripheral surface 4*e* of the concave portion 4*a* on the downstream side and the rear surface of the layer thickness controlling member 5 is 6 mm. As a result, a gap g of 1 mm is provided between the edge 5*d* of the one end 5*c* of the layer thickness controlling member 5 and the inner peripheral surface 4*e* of the concave portion 4*a* formed inside the developing bath frame 4.

In addition, the concave portion 4*a* on the upstream side of the rotation direction of the toner carrier 1 extends nearly halfway around the toner carrier 1 from the one end 5*c* of the layer thickness controlling member 5 to the upstream side of the rotation direction of the toner carrier 1 so as to cover the outer peripheral surface of the toner carrier 1 on the side of the supply roller 12. Furthermore, the concave portion 4*a* on the downstream side of the rotation direction of the toner carrier 1 is formed so as to extend from the layer thickness controlling member 5 to the downstream side of the rotation direction of the toner carrier 1 in the peripheral direction of the toner carrier 1 as long as the length La of the flat portion 5*a*.

The upstream side sealing member 7 is disposed at both ends in the longitudinal direction of the toner carrier 1 and has a fur-planted cloth 7*b* which makes contact with the toner carrier 1 via toner and an outer peripheral sealing member 7*a* provided on the outer peripheral surface of the fur-planted cloth 7*b*, thereby to cover a nearly half of each end portion in the longitudinal direction of the outer peripheral surface of the toner carrier 1 on the side of the supply roller 12. As a result, the upstream side sealing member 7 fits into the entire region of the concave portion 4*a* on the upstream side.

The outer peripheral sealing member 7*a* has a width of 6 mm in the depth direction of FIG. 4, a width of 9 mm in the radial direction of the toner carrier 1, a cell density of 40 pieces/25 mm, and a hardness of about 196N in accordance with JIS K6401. The outer peripheral sealing member 7*a* is formed of a urethane foam material having independent bubbles. The outer surface of the outer peripheral sealing member 7*a* is bonded to the concave portion 4*a* of the developing bath frame 4 by using double-sided adhesive tape. However, the portion ranging up to 3 mm on the upstream side of the rotation direction of the toner carrier 1 from the contact portion wherein the outer peripheral sealing portion 7*a* makes contact with the layer thickness controlling member 5 is not bonded to the concave portion 4*a* on the upstream side but just inserted therein so as not to interfere the movement of the layer thickness controlling member 5.

The upstream side sealing member 7 makes pressure contact with the outer peripheral surface of the toner carrier 1 in a direction perpendicular thereto along the entire sealing region from the one end 5*c* of the layer thickness controlling member 5 to a portion making contact with the lower seal 11 provided on the bottom surface of the developing bath frame 4. The upstream side sealing member 7 can therefore hold the layer thickness controlling member 5 and can prevent toner leakage at both ends in the longitudinal direction of the layer thickness controlling member 5. The thickness of the outer peripheral sealing member 7*a* in the radial direction of the toner carrier 1 is 9 mm, and the distance Ha between the inner peripheral surface 4*e* of the concave portion 4*a* on the upstream side and the outer peripheral surface of the toner carrier 1 is 6 mm. The upstream side sealing member 7 is therefore compressed in the radial direction of the toner carrier 1, and makes pressure contact with the toner carrier 1 by virtue of its elastic force. Furthermore, the upstream side sealing member 7 on the upstream side prevents the toner 2 from being supplied from the supply roller 12. It is thus possible to prevent the thickness of the toner layer in the vicinity of both ends portions in the longitudinal direction of the toner carrier 1 from becoming excessive.

The length of the fur of the fur-planted cloth 7*b* is about 2 mm, that is, 1.5 times as long as the radius of curvature of the bent portion 5*b*. In other words, the fur has a length such that the end of the fur reaches the contact portion wherein the layer thickness controlling member 5 makes contact with the toner carrier 1. In addition, the fur-planted cloth 7*b* is bonded to the outer peripheral sealing member 7*a* by using double-sided adhesive tape so that the direction of fur planting is a forward direction wherein the end of the fur tilts to the downstream side of the rotation direction of the toner carrier 1. Therefore, when the toner carrier 1 rotates, the end of the fur of the fur-planted cloth 7*b* is pushed into the contact portion wherein the layer thickness controlling member 5 makes contact with the toner carrier 1 at the upstream side sealing member 7. The end of the pushed fur fills the gap at the contact portion. As a result, it is possible to securely prevent toner leakage from the image region 13 at the contact portion to the outside of the upstream side sealing member 7. Furthermore, the fur-planted cloth 7*b* lowers the sliding friction load and abrasion occurring between the toner carrier 1 and the upstream side sealing member 7.

As described above, the concave portion 4*a* is also formed on the rear side of the contact portion wherein the layer thickness controlling member 5 makes contact with the toner carrier 1. The concave portion 4*a* extends to the fixed end 5*e* along the flat portion 5*a* of the layer thickness controlling member 5. The space defined by the concave portion 4*a* on the downstream side of the rotation direction of the toner carrier 1 and the layer thickness controlling member 5 has a width of 6 mm in the depth direction, a distance Hb of 6 mm in the height direction and a length of 15 mm in the right-to-left direction in FIG. 5.

The downstream side sealing member 8 is formed of a soft urethane foam material having independent bubbles, and disposed at both ends portions in the longitudinal direction of the toner carrier 1. The downstream side sealing member 8 has the same shape as that of the space defined by the above-mentioned concave portion 4*a* on the downstream side and the layer thickness controlling member 5. The downstream side sealing member 8 has a width of 6 mm in the depth direction, a thickness of 6 mm in the height direction and a length of 15 mm in the right-to-left direction. The downstream side sealing member 8 is bonded to the developing bath frame 4 and the layer thickness controlling member 5, and disposed to completely fill the space defined by the developing bath frame 4 and the layer thickness controlling member 5. Since the downstream side sealing member 8 is disposed inside both ends in the longitudinal direction of the layer thickness controlling member 5, the downstream side sealing member 8 does not make contact with the toner carrier 1. As a result, it is possible to prevent any sliding friction load and abrasion from occurring between the toner carrier 1 and the downstream side sealing member 8.

The downstream side sealing member 8 is formed of a soft foam material having a hardness of 250N or less in accordance with JIS K6401. The downstream side sealing member 8 can therefore securely prevent toner leakage by applying a low sealing contact pressure, and can prevent interference with the movement of the layer thickness controlling member 5.

Between the upstream side sealing member 7 which makes contact with the one end 5*c* from the upstream side of the rotation direction, and the downstream side sealing member 8 which makes contact with the one end 5*c* from the downstream side of the rotation is caught the one end 5*c* of the layer thickness controlling member 5. Above the edge 5*d*, the upstream side sealing member 7 and the downstream side sealing member 8 are not bonded to each other but just make slight contact with each other so as not to interfere with the movement of the layer thickness controlling member 5 in the radial direction of the toner carrier 1. In this way, the layer thickness controlling member 5 is held by the upstream side and downstream side sealing members 7 and 8 so that it can be displaced elastically in the radial direction of the toner carrier 1.

The upstream side sealing member 7 is not secured to the layer thickness controlling member 5 but just makes pressure contact therewith in the peripheral direction of the toner carrier 1. The downstream side sealing member 8 has the same shape as that of the space to be sealed, which is defined by the concave portion 4*a* and the layer thickness controlling member 5. As a result, the upstream side and downstream side sealing members 7 and 8 do not increase the contact pressure applied from the layer thickness controlling member 5 to the toner carrier 1, whereby it is possible to prevent any adverse effects on the formation of the toner layer 6 by the layer thickness controlling member 5.

For this reason, even if the sealing pressure between the upstream side sealing member 7 and the layer thickness controlling member 5 is raised, a contact pressure force is applied to the layer thickness controlling member 5 in the peripheral direction of the toner carrier 1, but the component of the contact pressure force in the radial direction of the toner carrier 1 is almost negligible. The toner layer formation can thus be carried out regardless of the sealing pressure.

In addition, the bent portion 5*b* makes elastic contact with the toner carrier 1 via toner, whereby the thickness of the toner layer is controlled at about 15 $\mu$m, and a uniform toner layer 6 having a charged amount of about 10 to 15 $\mu$C/mg is formed. The toner layer 6 is transferred to the developing portion of the developing apparatus wherein the toner carrier 1 makes contact with the image carrier 3 as the toner carrier 1 rotates. The toner is attached to an electrostatic latent image on the image carrier 3 at the developing portion, and reverse development is performed. After the development, the toner remaining on the toner carrier 1 passes through the space between the toner carrier 1 and the lower seal 11 formed of a polyester film (Mylar film by Du Pont) having a thickness of about 100 $\mu$m and is returned into the developing bath as the toner carrier 1 rotates.

In the developing apparatus 20 having the above-mentioned configuration, it is possible to securely prevent toner leakage from both ends in the longitudinal direction of the layer thickness controlling member 5, from the contact portion wherein the layer thickness controlling member 5 makes contact with the toner carrier 1 and from the one end 5*c* of the layer thickness controlling member 5. Furthermore, it is possible to supply the toner layer 6 having a uniform thin thickness to the image carrier 3.

Figure 6:
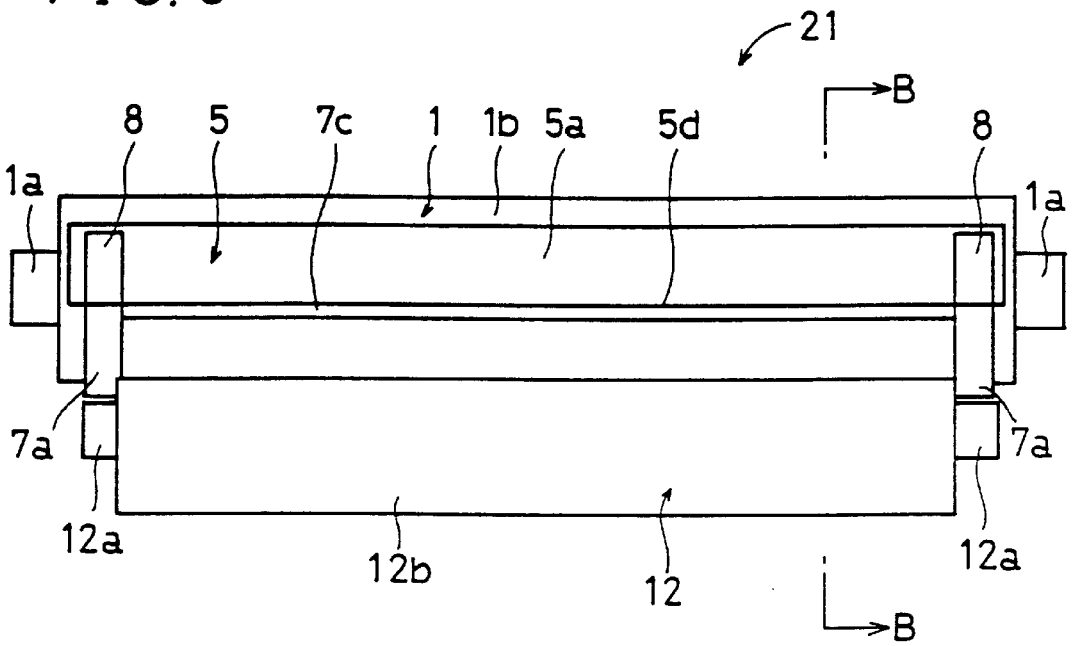
FIG. 6 is a top plan view showing a part of a developing apparatus 21 in accordance with another embodiment of the invention.
Figure 7:
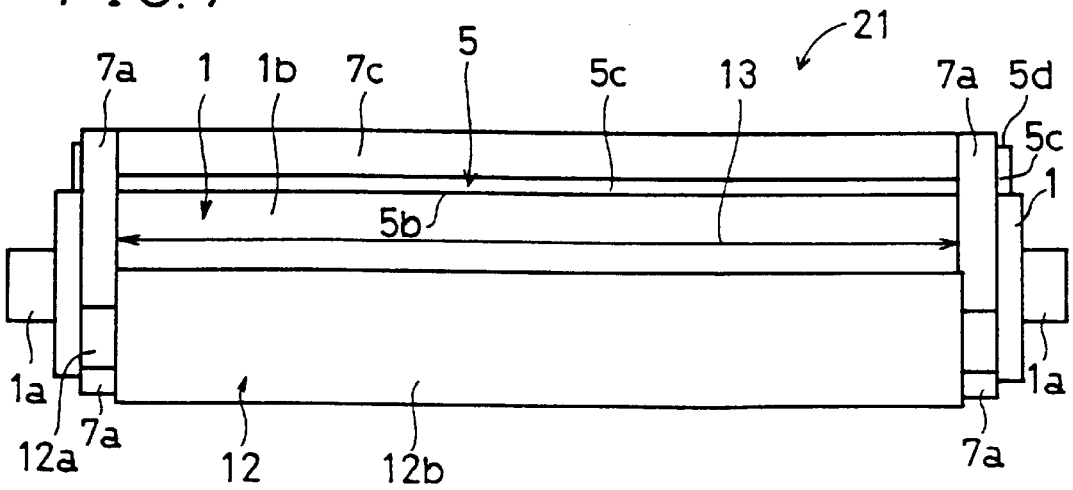
FIG. 7 is a rear view showing a part of the developing apparatus 21.
Figure 8:
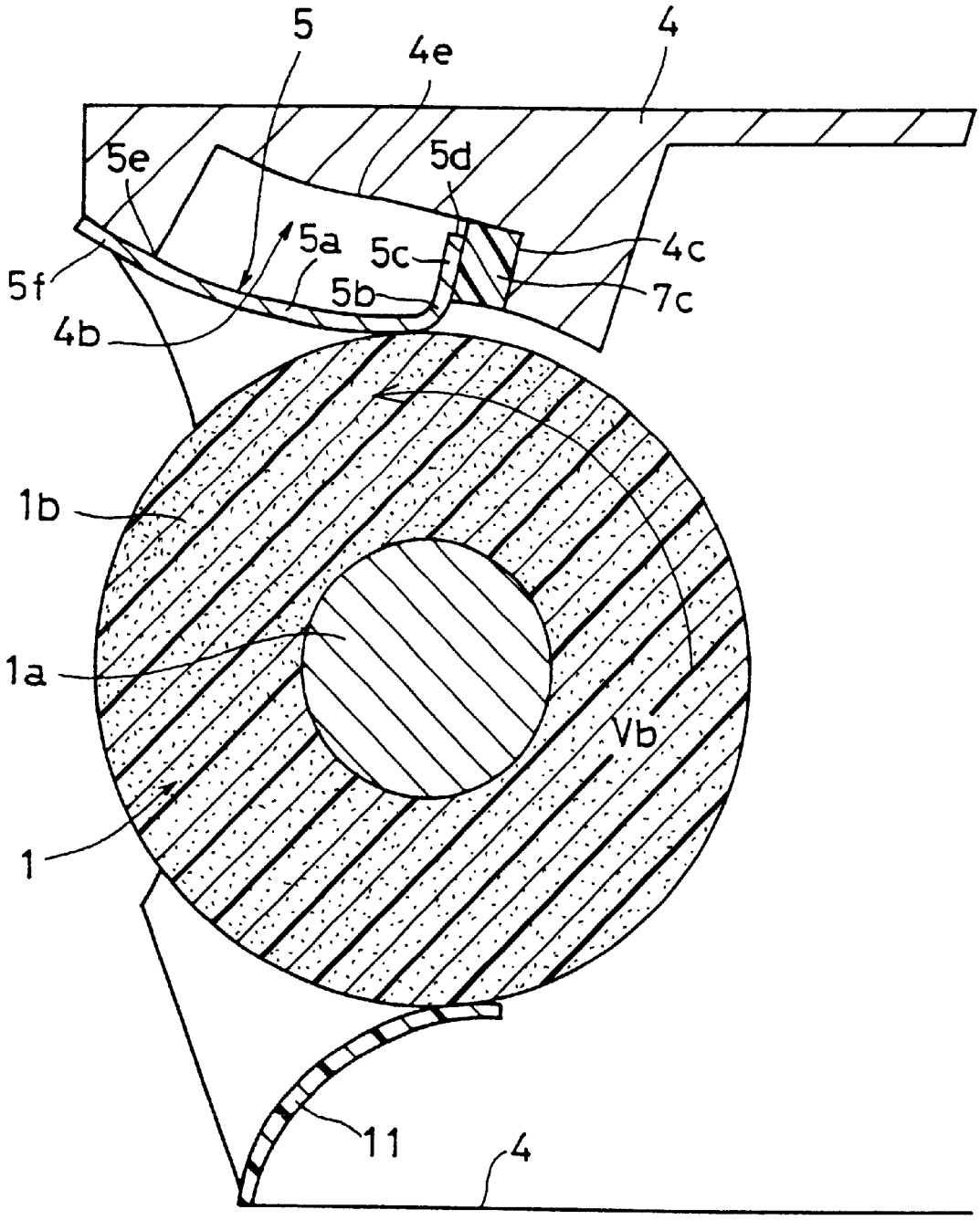
FIG. 8 is a magnified view showing the vicinity of the toner carrier 1 of the developing apparatus 21.
Figure 9:
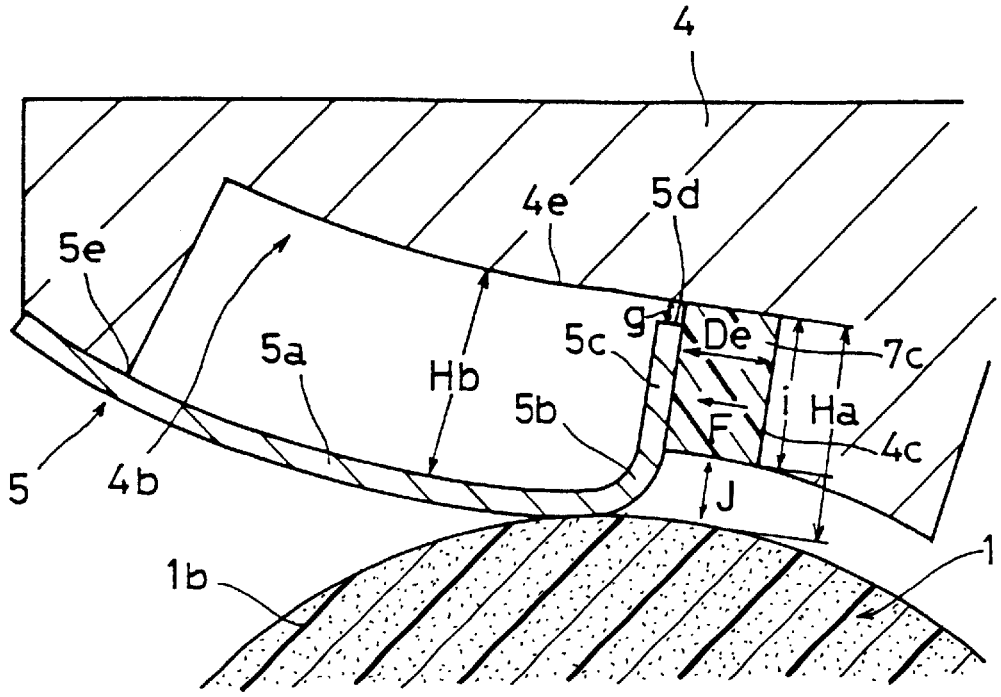
FIG. 9 is a magnified view showing the vicinity of the layer thickness controlling member 5 of the developing apparatus 21.

FIG. 6 is a top plan view showing a part of a developing apparatus 21 in accordance with another embodiment of the invention. FIG. 7 is a rear view showing a part of the developing apparatus 21. FIG. 8 is a magnified view showing the vicinity of the toner carrier 1 of the developing apparatus 21. FIG. 9 is a magnified view showing the vicinity of the layer thickness controlling member 5. FIGS. 8 and 9 are sectional views taken on the section line B—B of FIG. 6. The developing apparatus 21 is provided with a central sealing member 7*c* making contact with the surface of the one end 5*c* of the layer thickness controlling member 5 on the upstream side of the rotation direction of the toner carrier 1 across the image region 13 of the developing apparatus 20 shown in FIGS. 1 to 5. The explanations of the same components as those of the developing apparatus 20 shown in FIGS. 1 to 5 are omitted in the following descriptions of the developing apparatus 21.

A concave portion 4*b* extending across the image region 13 in the longitudinal direction of the layer thickness controlling member 5 is formed inside the ceiling wall of the developing bath frame 4 of the developing apparatus 21. The concave portion 4*b* is formed above the toner carrier 1 in the range from the one end 5*c* of the layer thickness controlling member 5 to the upstream side of the rotation direction of the toner carrier 1, and is also formed along the flat portion 5*a* of the layer thickness controlling member 5 on the downstream side.

The central sealing member 7*c* is provided in the concave portion 4*b* across the image region 13 on the upstream side of the rotation direction of the toner carrier 1. Furthermore, the central sealing member 7*c* is disposed between the one end 5*c* of the layer thickness controlling member 5 and the side surface 4*c* of the concave portion 4*b* on the upstream side, opposed to the one end 5*c* in parallel thereto. In addition, the central sealing member 7*c* is bonded and secured to the side surface 4*c* by using double-sided adhesive tape. The central sealing member 7*c* is compressed in the right-to-left direction of FIG. 9 by the one end 5*c* of the layer thickness controlling member 5 and the side surface 4*c* of the concave portion 4*b*.

For this reason, the central sealing member 7*c* makes pressure contact with the one end 5*c* by virtue of its elasticity at a contact pressure force in the direction of arrow F, i.e., in the peripheral direction of the toner carrier 1. The central sealing member 7*c* can thus prevent toner from getting over the edge 5*d* of the one end 5*c* and going to the downstream side of the rotation direction of the toner carrier 1. As a result, the central sealing member 7*c* can securely seal toner along the nearly entire length of the toner carrier 1. In addition, since the central sealing member 7*c* does not make contact with the toner carrier 1, it is possible to prevent any sliding friction load and abrasion from occurring between the central sealing member 7*c* and the toner carrier 1.

The distance Ha between the inner peripheral surface 4*e* of the concave portion 4*b* on the upstream side of the rotation direction of the toner carrier 1 and the outer peripheral surface of the toner carrier 1 is 6 mm. In addition, the distance Hb between the inner peripheral surface 4*e* of the concave portion 4*a* on the downstream side and the rear surface of the layer thickness controlling member 5 is 6 mm. The distance De in the right-to-left direction of FIG. 9 between the one end 5*c* of the layer thickness controlling member 5 and the side surface 4*c* of the concave portion 4*b* on the upstream side, opposed to the one end 5*c* in parallel thereto is 2.5 mm. The gap g in the height direction between the edge 5*d* of the layer thickness controlling member 5 and the inner peripheral surface 4*e* of the concave portion 4*b* on the downstream side is 1 mm. The height i of the side surface 4*c* is 5 mm.

The central sealing member 7*c* has a width of 3 mm in the peripheral direction of the toner carrier 1 and has a thickness of 5 mm in its radial direction. The central sealing member 7*c* is made of the same material as that of the outer peripheral sealing member 7*a*. The central sealing member 7*c* is disposed between the side surface 4*c* of the concave portion 4*b* and the one end 5*c* of the layer thickness controlling member 5 with a gap J of 1 mm provided to the toner carrier 1 in its radial direction. Since the distance De between the side surface 4*c* of the concave portion 4*b* and the one end 5*c* is 2.5 mm, the central sealing member 7*c* having a width of 3 mm in the peripheral direction of the toner carrier 1 is compressed in the right-to-left direction of FIG. 9. The developing apparatus 21 may be provided with a central sealing member for holding the one end 5*c* on the downstream side of the rotation direction of the toner carrier 1 across the image region 13 in order to enhance the sealing effect.

Figure 10:
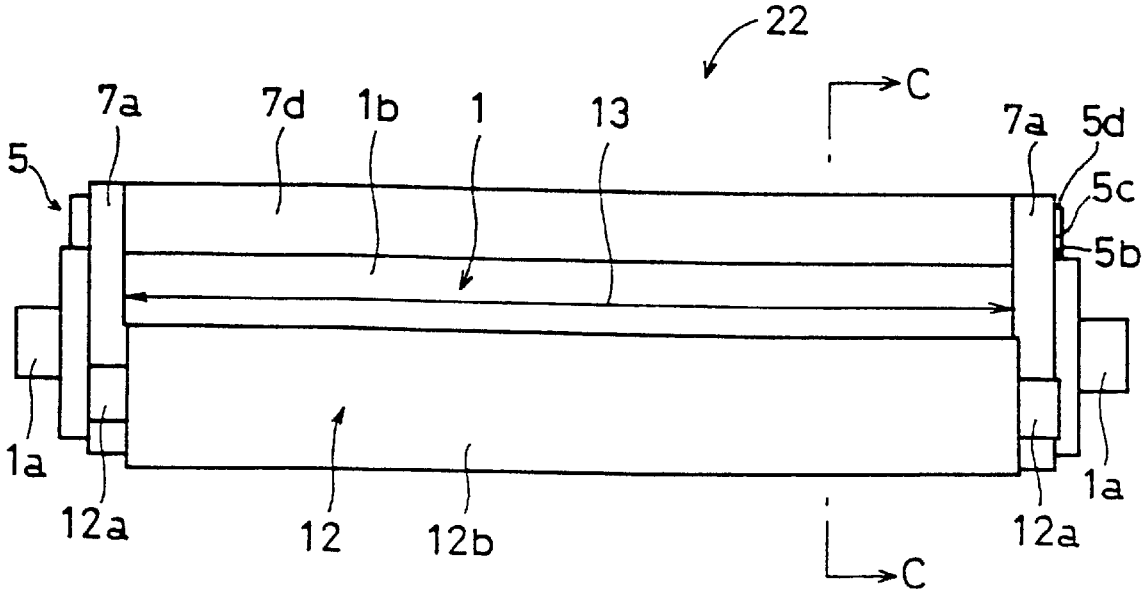
FIG. 10 is a rear view showing a part of a developing apparatus 22 in accordance with still another embodiment of the invention.
Figure 11:
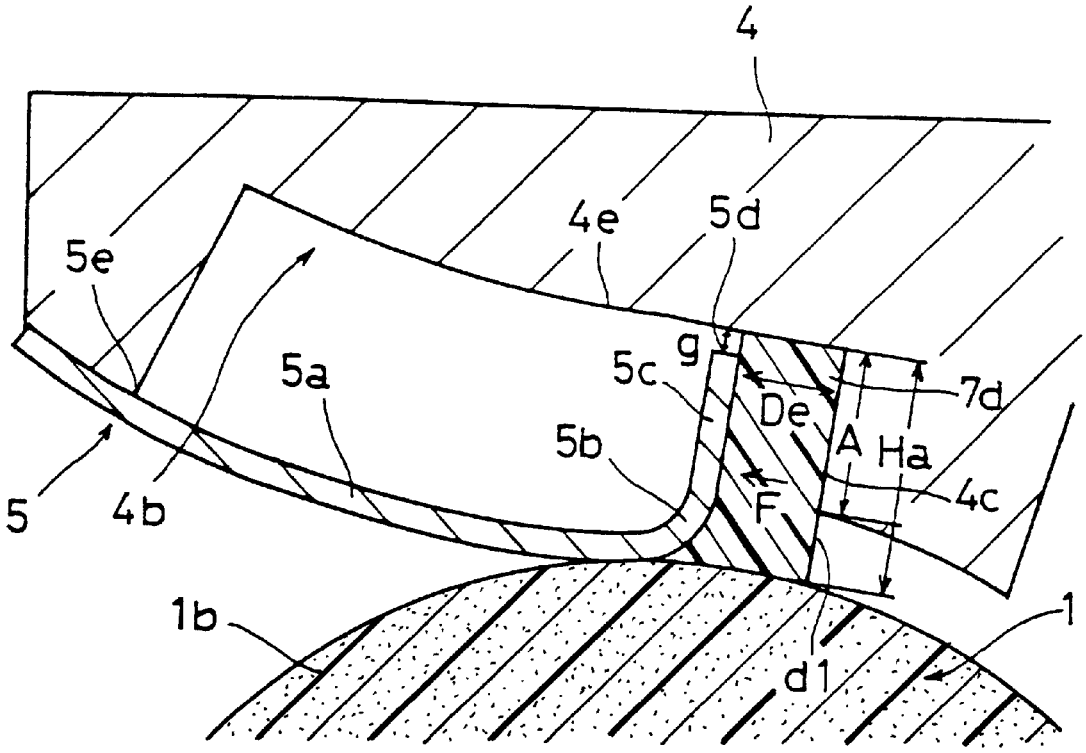
FIG. 11 is a magnified view showing the vicinity of the layer thickness controlling member 5 of the developing apparatus 22.

FIG. 10 is a rear view showing a part of a developing apparatus 22 in accordance with still another embodiment of the invention. FIG. 11 is a magnified view showing the vicinity of the layer thickness controlling member 5 of the developing apparatus 22 and taken on the section line C—C of FIG. 10. The explanations of the same components as those of the developing apparatus 21 shown in FIGS. 6 to 9 are omitted in the following descriptions of the developing apparatus 22.

The developing apparatus 22 is provided with a central sealing member 7*d* making pressure contact with the outer peripheral surface of the toner carrier 1 in a direction perpendicular thereto across the image region 13, instead of the central sealing member 7*c* of the developing apparatus 21. The same concave portion 4*b* as that of the developing apparatus 21 is formed in the developing bath frame 4 of the developing apparatus 22. The central sealing member 7*d* has a skin layer at its lower surface. The upper end portion of the side surface $d_1$ of the central sealing member 7*d* on the upstream side of the rotation direction of the toner carrier 1 is bonded and secured to the side surface 4*c* of the concave portion 4*b* on the upstream side across a region A by using double-sided adhesive tape. The distance Ha between the inner peripheral surface 4*e* of the concave portion 4*b* on the upstream side of the rotation direction of the toner carrier 1 and the outer peripheral surface of the toner carrier 1 is 6 mm. In addition, the thickness of the central sealing member 7*d* in the radial direction of the toner carrier 1 is 6.5 mm. Therefore, the central sealing member 7*d* is compressed about 0.5 mm in the radial direction of the toner carrier 1. The central sealing member 7*d* thus makes pressure contact with the toner carrier 1 via toner by using its elasticity.

Just like the central sealing member 7*c*, the central sealing member 7*d* makes pressure contact with the layer thickness controlling member 5 by virtue of the contact pressure force applied in the direction of arrow F. For this reason, the central sealing member 7*d* can prevent toner leakage to the downstream side. In addition, at the pressure contact portion of the lower surface of the central sealing member 7*d* making contact with the toner carrier 1, the central sealing member 7*d* makes pressure contact with the outer peripheral surface of the toner carrier 1 inward in its radial direction. As a result, coagulated toner lumps supplied to the contact portion wherein the toner carrier 1 makes contact with the layer thickness controlling member 5 are loosened. In addition, the supplied toner is preliminarily charged and subjected to other processing. The toner can thus be formed into a layer having higher uniformity and stability.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus which performs development by supplying a thin toner layer to an electrostatic latent image on an image carrier, comprising:

a cylindrical toner carrier for transferring supplied toner to a development position by rotation of the toner carrier;

supply means for supplying toner to an outer peripheral surface of the toner carrier;

a layer thickness controlling member for controlling thickness of the supplied toner to within a predetermined value while making slide contact with the outer peripheral surface of the toner carrier; and sealing means for holding the layer thickness controlling member and preventing toner leakage, wherein the layer thickness controlling member is formed of an elastic plate extending in parallel with the toner carrier, and has a bent portion which is convex toward the toner carrier and makes elastic contact with the outer peripheral surface of the toner carrier over a nearly entire length thereof, one end of the layer thickness controlling member in a width direction thereof with respect to the bent portion outwardly extending in a radial direction of the toner carrier, a portion on the other side of the layer thickness controlling member in the width direction thereof extending in a peripheral direction of the toner carrier toward a downstream side of the rotation direction of the toner carrier, and the sealing means consisting of an upstream side sealing member which makes contact with the one end of the layer thickness controlling member from an upstream side of the rotation direction of the toner carrier and a downstream side sealing member which makes contact with the one end of the layer thickness controlling member from a downstream side of the rotation direction of the toner carrier, the one end of the layer thickness controlling member being caught between the upstream side sealing member and the downstream side sealing member so that the layer thickness controlling member is held to be elastically displaceable in the radial direction of the toner carrier.

2. The developing apparatus of claim 1, wherein a main component of a pressure contact force exerted from the upstream side sealing member to the layer thickness controlling member is in parallel with the peripheral direction of the toner carrier.

3. The developing apparatus of claim 1, wherein the sealing means is disposed at both ends in a longitudinal direction of the layer thickness controlling member and the upstream side sealing member has a side sealing member which makes contact with the toner carrier.

4. The developing apparatus of claim 3, wherein the side sealing member has a fur-planted cloth at a contact portion thereof which makes contact with the toner carrier.

5. The developing apparatus of claim 4, wherein a fur-planting direction of the fur-planted cloth is a forward direction wherein an end of the fur tilts to the downstream side of the rotation direction of the toner carrier.

6. The developing apparatus of claim 4, wherein the fur of the fur-planted cloth has such a length that the end of the fur reaches the contact portion wherein a toner carrier side surface of the convex bent portion of the layer thickness controlling member which is bent at a predetermined radius of curvature, makes contact with the outer peripheral surface of the toner carrier.

7. The developing apparatus of claim 1, wherein the upstream side sealing member has a central sealing member for holding the layer thickness controlling member over a nearly entire length in a longitudinal direction of the layer thickness controlling member.

8. The developing apparatus of claim 7, wherein the central sealing member does not make contact with the toner carrier.

9. The developing apparatus of claim 7, wherein the central sealing member makes contact with the toner carrier at least in an effective region of an image.

10. The developing apparatus of claim 1, wherein the upstream side sealing member is formed of a soft foam material having independent bubbles.

11. The developing apparatus of claim 1, wherein the downstream side sealing member is bonded to a wall surface of a frame of a developing bath for accommodating toner.

12. The developing apparatus of claim 1, wherein the downstream side sealing member is bonded to the layer thickness controlling member.

13. The developing apparatus of claim 1, wherein the downstream side sealing member is positioned inside both ends in a longitudinal direction of the layer thickness controlling member and do not make contact with the toner carrier.

14. The developing apparatus of claim 1, wherein a main component of a pressure contact force exerted from the downstream side sealing member to the layer thickness controlling member is in parallel with the peripheral direction of the toner carrier.

15. The developing apparatus of claim 1, wherein the downstream side sealing member is formed of a soft foam material having independent bubbles.

16. The developing apparatus of claim 1, wherein the downstream side sealing member is formed of a soft foam material having a hardness of 250N or less in accordance with JIS K6401.

* * * * *